US006845597B2

(12) United States Patent
Redmond

(10) Patent No.: US 6,845,597 B2
(45) Date of Patent: Jan. 25, 2005

(54) COMPACT FORM-FILL-SEAL MACHINE

(75) Inventor: Sanford Redmond, Stamford, CT (US)

(73) Assignee: Sanford Redmond, Inc., Stamford, CT (US)

( * ) Notice: Subject to any disclaimer, the term of this patent is extended or adjusted under 35 U.S.C. 154(b) by 0 days.

(21) Appl. No.: 10/445,029

(22) Filed: May 27, 2003

(65) Prior Publication Data

US 2004/0055260 A1 Mar. 25, 2004

Related U.S. Application Data

(63) Continuation-in-part of application No. 09/626,562, filed on Jul. 27, 2000, now abandoned.
(60) Provisional application No. 60/145,646, filed on Jul. 27, 1999.

(51) Int. Cl.[7] ..... B65B 1/04
(52) U.S. Cl. ..... 53/260; 53/133.8; 53/248; 53/373.7
(58) Field of Search ..... 53/133.3, 133.8, 53/373.7, 375.7, 329.4, 306, 246, 248, 247, 255, 260; 206/469, 538, 820, 532, 484; 83/879, 171, 170

(56) References Cited

U.S. PATENT DOCUMENTS

| | | | | |
|---|---|---|---|---|
| 3,874,143 A | | 4/1975 | Braber | |
| 4,215,607 A | | 8/1980 | Hudson et al. | |
| 4,218,155 A | | 8/1980 | Weidner | |
| 4,410,089 A | | 10/1983 | Bortolani | |
| 4,464,880 A | * | 8/1984 | Peters et al. | 53/260 |
| 4,476,664 A | * | 10/1984 | Kroll et al. | 53/260 |
| 4,493,574 A | | 1/1985 | Redmond et al. | |
| 4,608,808 A | * | 9/1986 | Ryan et al. | 53/248 |
| 4,611,715 A | | 9/1986 | Redmond | |
| 4,724,982 A | | 2/1988 | Redmond | |
| 4,790,429 A | | 12/1988 | Fukushima | |
| 4,819,406 A | | 4/1989 | Redmond | |
| 5,140,882 A | | 8/1992 | Hyder | |
| 5,358,118 A | | 10/1994 | Thompson et al. | |
| 5,364,484 A | | 11/1994 | Redmond | |
| 5,369,932 A | * | 12/1994 | Passero | 53/248 |
| 5,395,031 A | | 3/1995 | Redmond | |
| 5,477,660 A | | 12/1995 | Smith | |
| 5,494,192 A | | 2/1996 | Redmond | |
| 5,517,805 A | | 5/1996 | Epstein | |
| 5,682,729 A | | 11/1997 | Buchko | |
| 5,740,717 A | | 4/1998 | Sowden et al. | |
| 5,826,737 A | | 10/1998 | Zakensberg | |
| 5,839,609 A | | 11/1998 | Zakensberg | |
| 6,062,413 A | | 5/2000 | Redmond | |
| 6,085,942 A | | 7/2000 | Redmond | |
| 6,299,012 B1 | | 10/2001 | Redmond | |
| 6,470,782 B1 | | 10/2002 | Shimotoyodome et al. | |

* cited by examiner

*Primary Examiner*—Louis Huynh
(74) *Attorney, Agent, or Firm*—Kenyon & Kenyon

(57) ABSTRACT

A compact form-fill-seal machine capable of the high speed production, collation and loading into cartons of a variety of small dispensing packages with instant opening features including fault lines in the lower containment formation. It can make a variety of formations in the upper cover member as well as fault lines. It also produces simple cups and tubs. The machine operates at extremely high efficiency with practically every known thermoformable plastic film.

17 Claims, 12 Drawing Sheets

COMPACT FORM-FILL-SEAL MACHINE

CROSS-REFERENCE TO RELATED APPLICATIONS

This application is a continuation of application Ser. No. 09/626,562, filed Jul. 27, 2000, now abandoned which claims the benefit of U.S. Provisional Application No. 60/145,646, filed Jul. 27, 1999, which is incorporated herein by reference in its entirety.

RELATED PATENTS

On Apr. 11, 1989 U.S. Pat. No. 4,819,406, which is hereby incorporated by reference, was issued to applicant for a Compact Form-Fill-Seal Machine for producing sealed cups and other package structures including dispenser packages for flowable substances having a fault line extending over a stress concentrating protrusion member. The stress concentrating protrusion member was formed into a relatively stiff flat upper plastic film cover member of a lower product containment member. The dispenser package being the subject of U.S. Pat. Nos. 4,493,574, 4,611,715 and 4,724,982, all invented by applicant.

DETAILED DESCRIPTION OF THE PREFERRED EMBODIMENT

A new dispenser package having significant cost and other benefits and advantages beyond those of U.S. Patent Nos. 4,493,574, 4,611,715 and 4,724,982, which are hereby incorporated by reference, has been invented by the applicant. The new dispenser package includes the stress concentrating protrusion with fault line traversing it in the lower containment member of the new package, thereby eliminating the necessity for the costly relatively stiff, flat, upper plastic film cover. The stiff, flat, upper plastic film cover is replaced by a very thin, easily printed, low cost, flexible membrane like film. In the view of the fact that the space about and surrounding the lower forming die was not only crowded but involved a variety of accurately controlled temperatures for thermoforming and scoring, each of which must be independently maintained and isolated from the others, a more sophisticated scoring system had to be devised as compared to original method of scoring the upper web with a fixed blade. In addition, the scores for each package are not necessarily straight line scores in alignment, or even in a single linear orientation with each other, as would be scores made by drawing film past a fixed blade. Heated blades are embodied in this upgraded and improved machine. The blades are maintained within a narrow temperature range. (A typical temperature might be 365° F. +/−3°). These blades create score lines which are made to a selected depth in increments of 0.0002". This is accomplished by maintaining the blades in a fixed position approximately ⅛" beneath the plane of the film to be scored.

Figure 1:
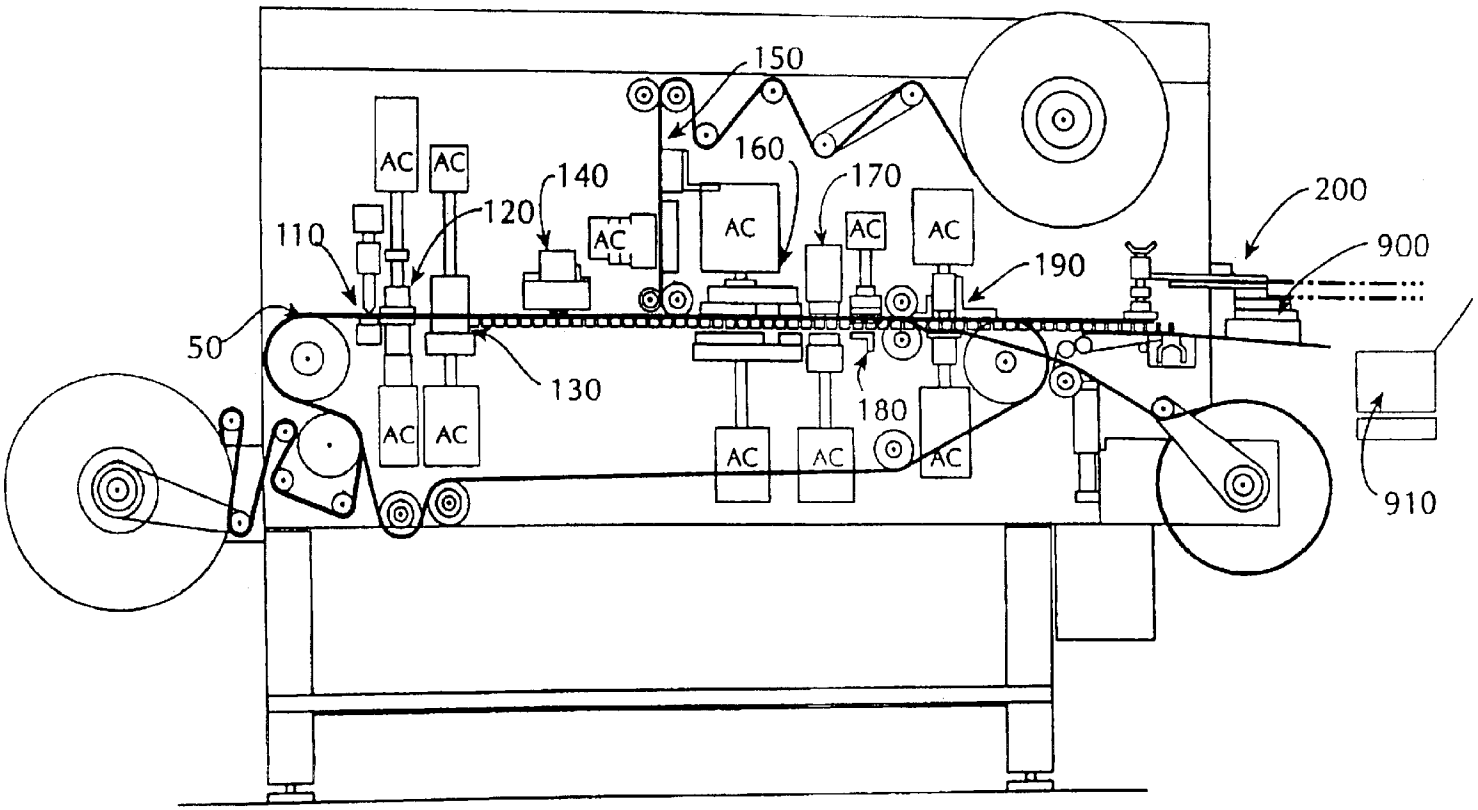
FIG. 1 illustrates an elevational side view of an embodiment of the machine of the present invention.
Figure 2:
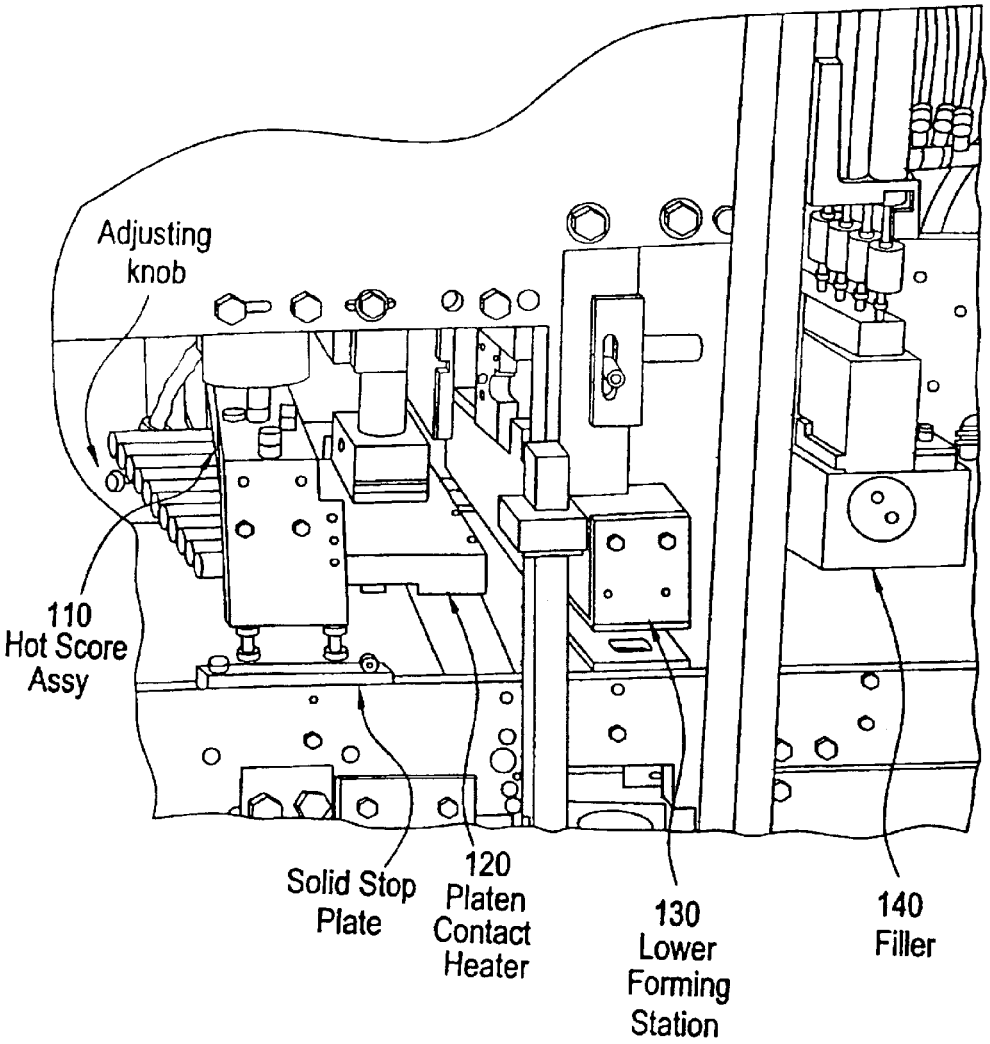
FIG. 2 illustrates a side elevational view of the hot score assembly, the platen contact heater assembly, the forming station assembly and the filler station.
Figure 5:
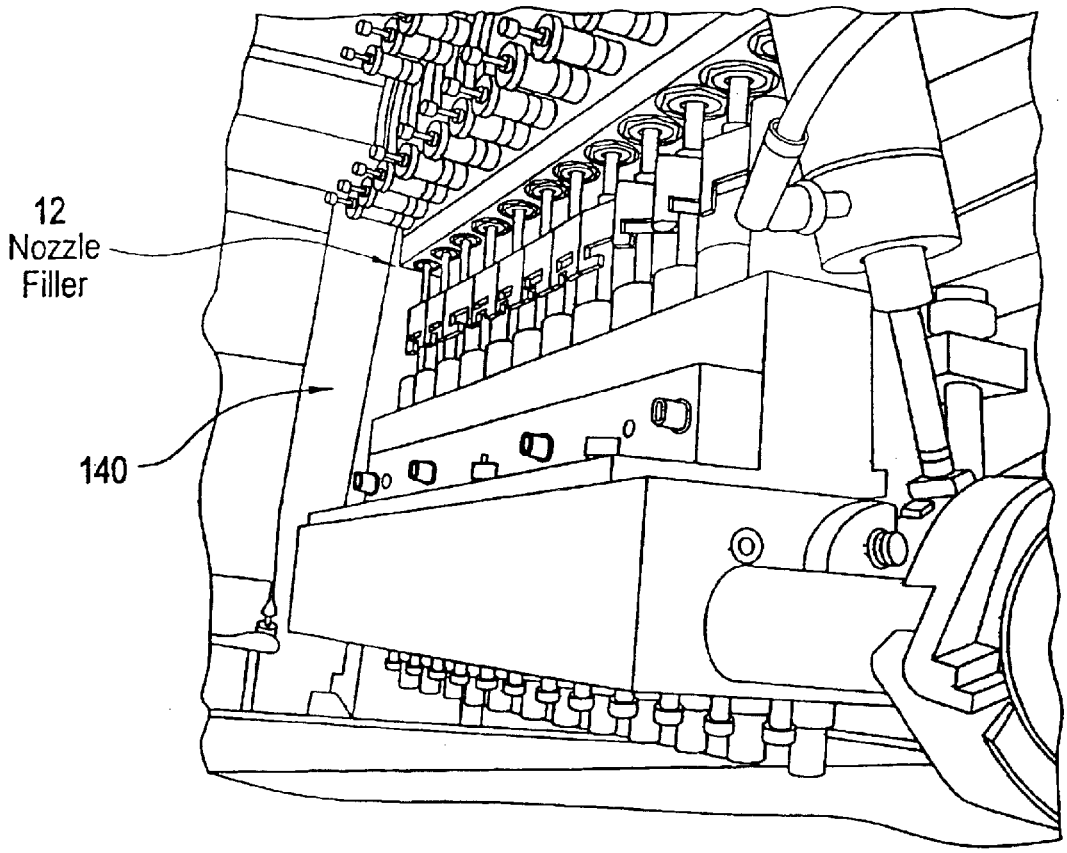
FIG. 5 illustrates a perspective view of the nozzle fillers.
Figure 6:
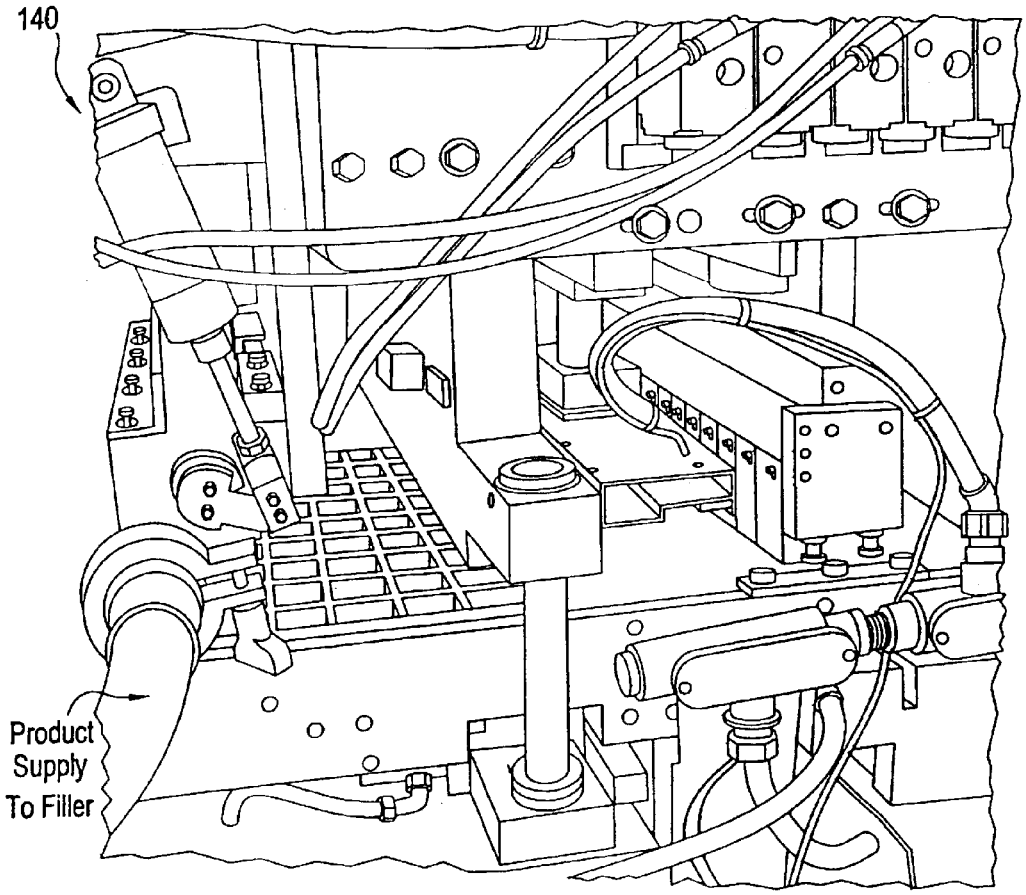
FIG. 6 illustrates a rear view of the machine showing the forming station assembly and the filler station.

An example of a machine in accordance with the invention is shown in FIG. 1. The machine is capable of automatic continuous high speed production of formed, filled, sealed packages. The machine comprises drive means to intermittently advance a pair of parallel transport chains having means to secure and pull bottom web material 50 from an intermittently braked roll of web of thermoformable plastic. The transport chains advance the bottom web material 50 past a series of stations. At a scoring station 110, the bottom web 50 is accurately scored, as described in more detail below. At a heating station 120, the bottom web 50 is controllably heated to thermoforming temperatures. At a forming station 130, the heated bottom web 50 is formed. The forming station 130 including forming die means which can form a series of spaced pocket formations. At a filler station 140, each pocket formation is filled with an equal amount of a product. FIG. 2 shows the scoring station 110, the heating station 120, the forming station 130, and the filler station 140. FIG. 6 shows a rear view of a similar area, while FIG. 5 shows the filler station 140 having a 12 nozzle filler.

Figure 7:
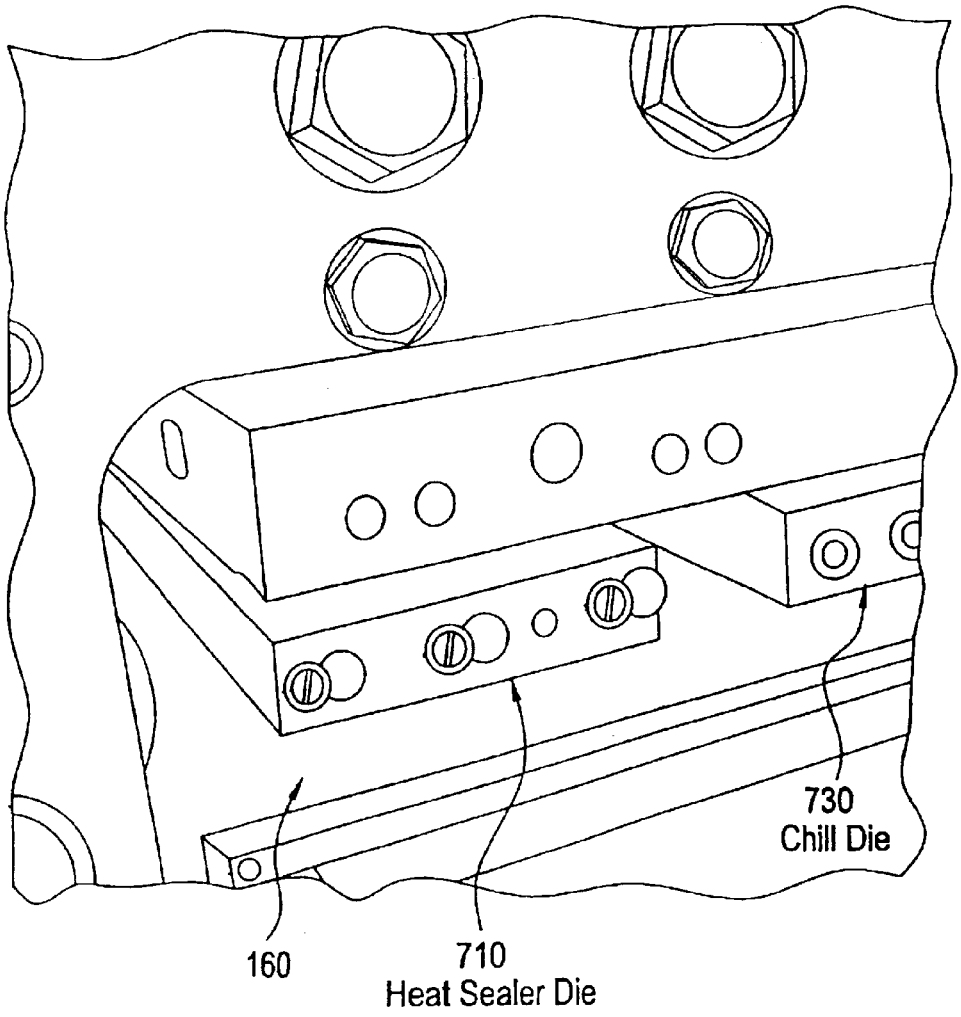
FIG. 7 illustrates a perspective view of the heat sealer die assembly.
Figure 8A:
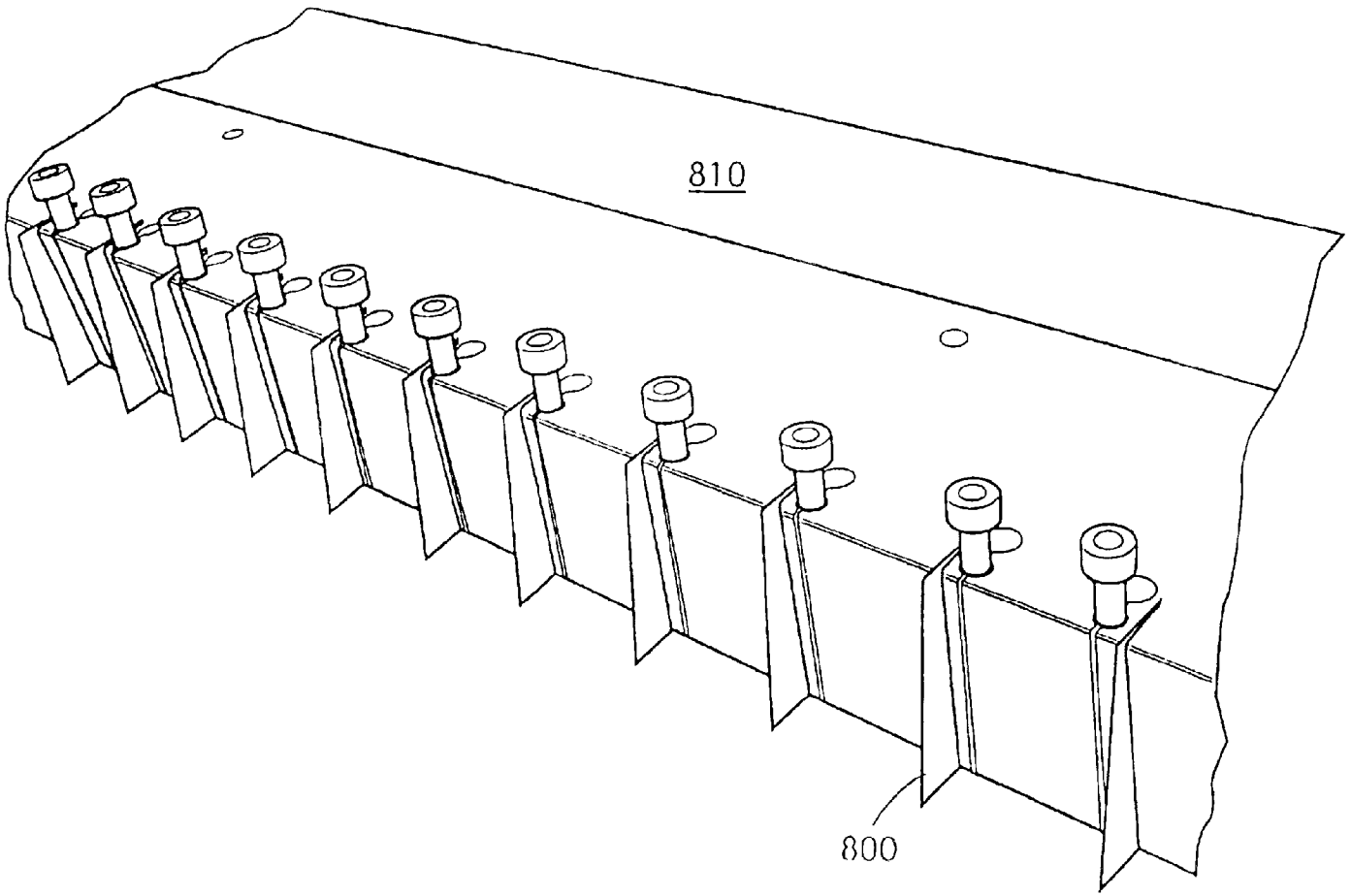
FIG. 8*a* illustrates a perspective view of the longitudinal chop assembly showing tapered blades.
Figure 8B:
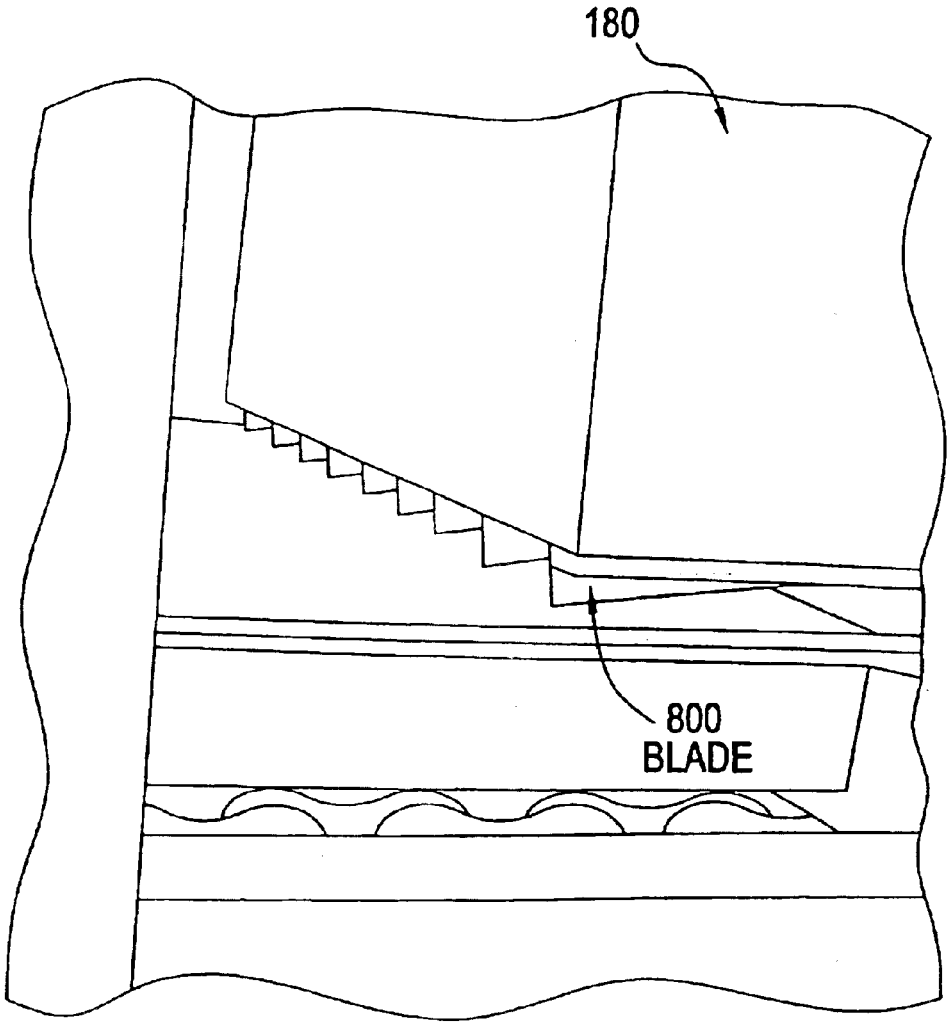
FIG. 8*b* illustrates another perspective view of the longitudinal chop assembly with tapered blades.
Figure 8C:
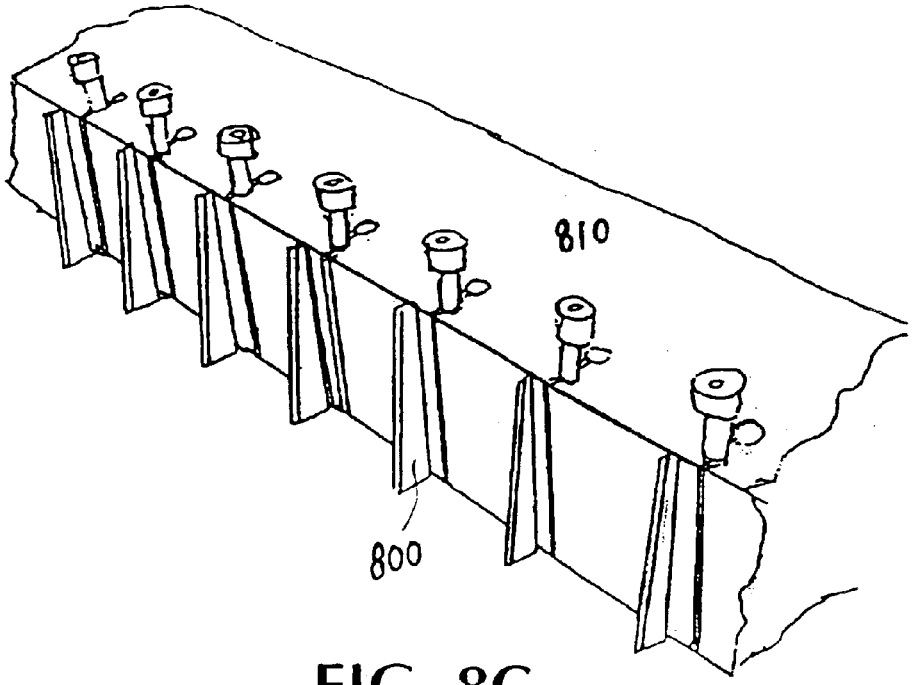
FIG. 8*c* illustrates a perspective view of the longitudinal chop assembly in a tipped over position.
Figure 8E:
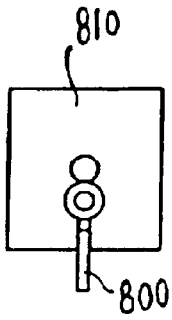
FIG. 8*e* illustrates a top view of the clamp screw with blade.
Figure 8D:
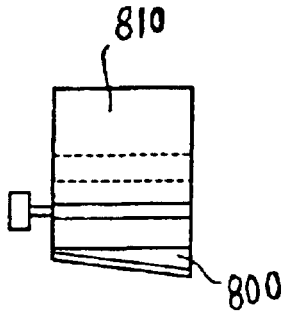
FIG. 8*d* illustrates a side view of a clamp screw with blade.

As shown in FIG. 1, the machine further comprises driven roller means intermittently advancing a top web material in timed relationship with the intermittent advance of said bottom web 50. The driven roller means transports the top web in substantially parallel, closely adjacent proximity to and above the filled pocket formations to a sealing station 160 where the top web is sealed to the bottom web 50. FIG. 7 shows the sealing station 160, with a heat sealer die 710 and a chill die 730.

The transport chains next advance the sealed bottom web and top web combination to a further series of stations. At a punch station 170, shaped apertures are punched in the unformed sealed web areas which rim the pocket formations. The punched apertures are formed in straight lines, with a punched hole at each end of the line of pocket formations and one between each pocket formation. At a longitudinal cutting station 180, the films are sheared longitudinally in a cut which travels between the punched holes to create longitudinal rims along the pocket formations. A transverse cutting station 190 transversely slits the sealed areas between the pocket formation to create transverse rims and to completely separate the pocket formations, thereby producing individual generally rectangular finished packages with sealed rims and punched corners.

Figure 3B:
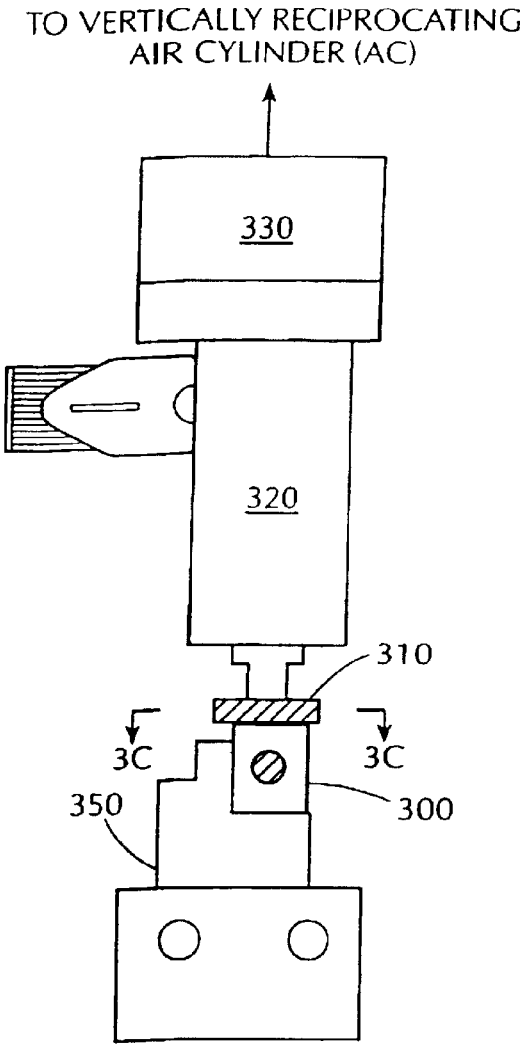
FIG. 3*b* illustrates a side elevational view of the hot score assembly.
Figure 3A:
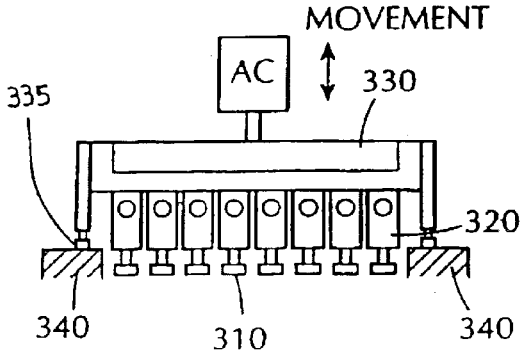
FIG. 3*a* illustrates a front elevational view of the hot score assembly.
Figure 3C:
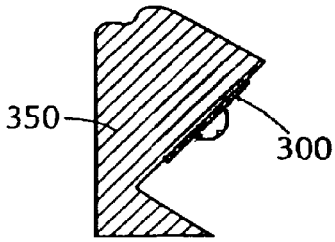
FIG. 3*c* illustrates an enlarged view of a section of the hot score assembly.

A detailed depiction of the scoring station 110 is shown in FIGS. 3*a*–3*c*. Situated above the film 50 and located directly over each blade 300 is a vertically reciprocating anvil 310. These anvils 310 each extend from an independent anvil adjustment mechanism 320 (one for each blade) which in turn is mounted on a common anvil mounting bar 330 which vertically reciprocates and which, at the bottom of its downward stroke, meets a solid stop 340 (the extent of this reciprocation can be adjusted with adjusting screws 335). The individual stop points of each anvil 310 are each independently adjusted by each anvil's own anvil adjustment mechanism 320 in increments of 0.0002" (two ten thousandths of an inch). Thus, the movement of the anvils 310 on their down stroke extends to a location such that, after each anvil contacts the film, presses it downward to the fixed heated scoring blade 300 and compresses the film onto the blade to the precisely controlled correct score depth.

It will be realized that the heat from the blades 300 and the heated blade holders 350 radiates and rises upward to the film 50 causing problems when the machine is stopped for any period significantly greater that the normal cycling stops of the intermittent drive. This heat is accommodated in the scoring and dissipated by an automatic jet of cooling air in the lower surface of the film when the machine is stopped for purpose other than its normal intermittent indexing rest cycle.

The blades 300 in a typical instance are oriented at a 45° angle to the axis of each package along its centerline. The need for this accuracy of depth and temperatures is that when the stress concentrator is in the containment portion of the package we are working with a heated, stretched and thus thin walled film. Mating male and female dies are generally required to produce accurately formed stress concentrators in addition to plug means. The upper plug has an accurately machined male die mounted to it to mesh with an accurately machined female die in the lower containment forming portion of the lower forming die. The overall forming die temperature must be maintained accurately at a temperature which is warm enough to allow formation of the film yet cool enough to not create a temperature buildup, the typical range might be 165°–175°. This is accomplished by bringing coolant fluid to this temperature.

Figure 4:
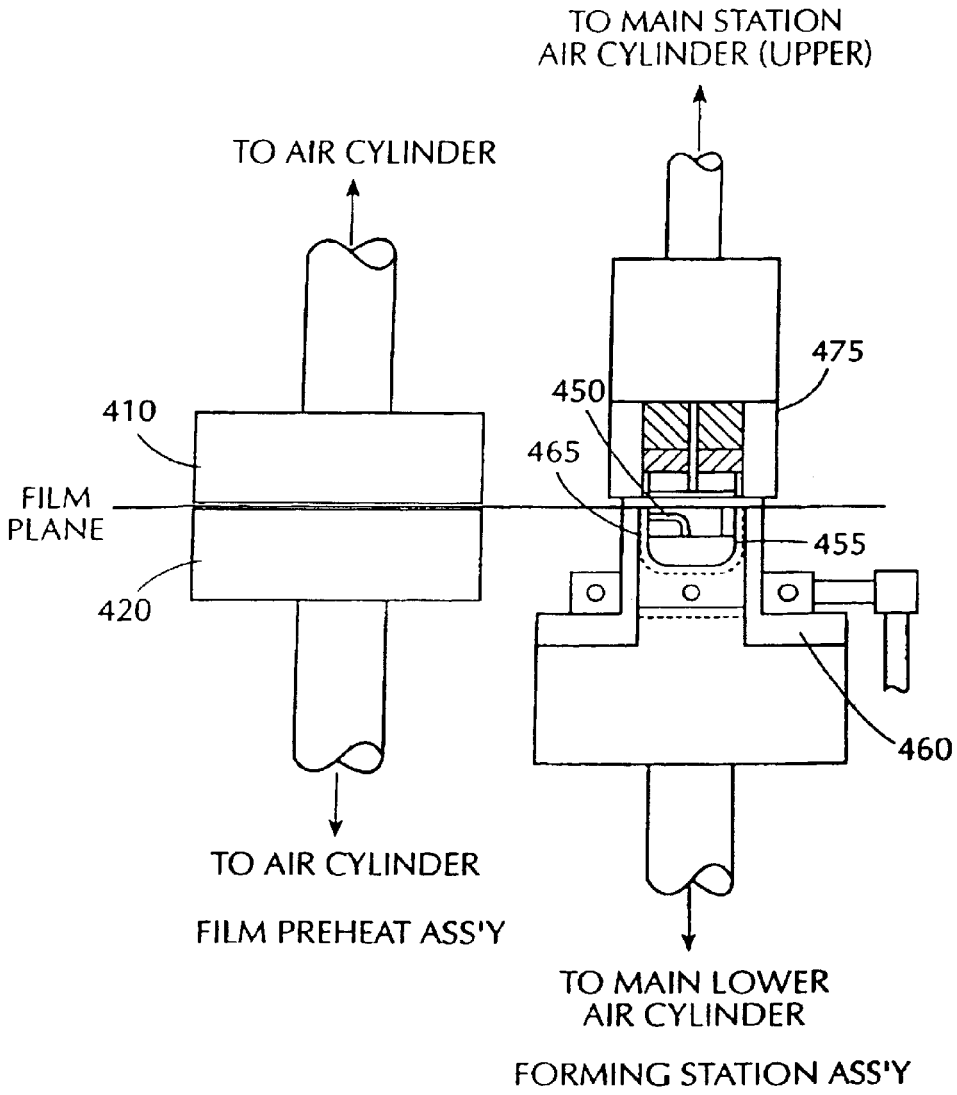
FIG. 4 illustrates a side view of the platen contact heater assembly and the forming station assembly.

FIG. 4 shows a detailed view of the film preheat assembly 120 and the forming station 130. As shown there, the forming station 130 has a forming die 460, a forming die cavity 465, a plug 455, a plug mounted stress concentrator die (male) 450, and a pressure frame 475. In the heating station 120, the use of upper and lower contact platen heaters 410, 420 is required all in the crowded space about the forming and scoring system. In some instances the line of packages may be increased from a single row to multiple rows, always maintaining a short index overall, relative to the width of the line of packages in order to keep the machine compact and to take advantage of the theory of a number of rapid short indexes rather than large index at slower rates as described in my U.S. Pat. No. 4,819,406.

In the '406 patent longitudinal slitting is accomplished by drawing the web of completely formed, filled and sealed packages through fixed blades. This was adequate when the package strength (rigidity) was supported by a relatively stiff, flat, thick upper member. In the instance of the new style package the very thin membrane like upper member supplies no strength to the packages' rigidity, and drawing the web of packages through those blades would case a drag which shows up as an are in the transverse alignment of the packages. A novel new means of slitting the package longitudinally is provided, an example of which is shown in FIGS. 8*a*–8*e*. A longitudinal cutting station 180 comprises a vertically reciprocating knife holder 810 holds a series of longitudinally parallel oriented blades 800 at an angle to the film plane of 20° to 30°. During the rest period of the intermittent index cycle, the knife holder 810 is lowered, with the lowest end of each knife blade 800 entering the punch hole at the trailing end of the package in its direction of index. The blades 800 are advanced vertically to longitudinally slit the packages during the rest period of the intermittent index cycle of the matrix of packages, between advances.

Subsequent to the longitudinal slitting, a vertically reciprocating chop station 190 makes the transverse cut during the rest period of the intermittent index cycle, creating independent packages for further processing.

Figure 9A:
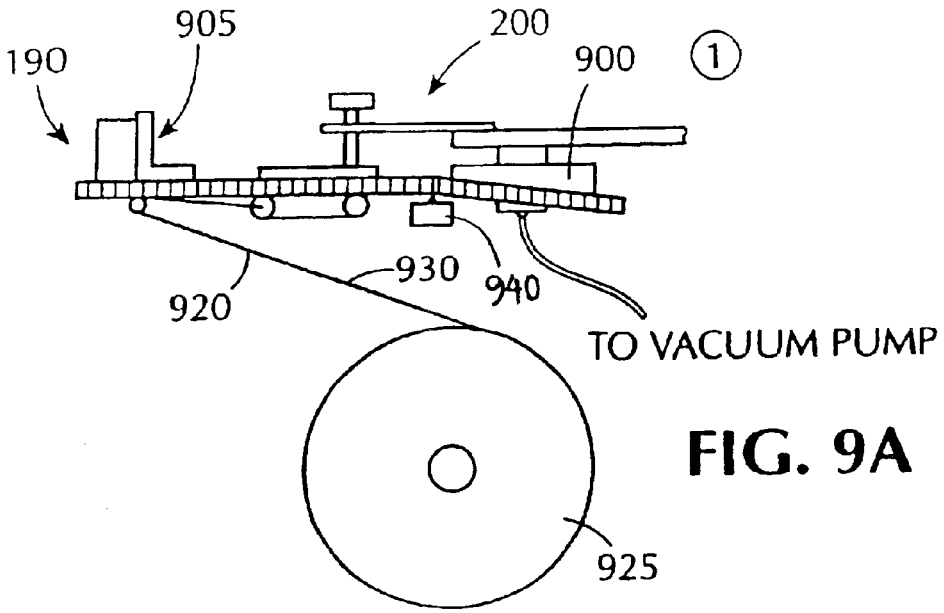
FIG. 9*a* illustrates a side view of the transport assembly.

As shown in FIG. 9*a*, in a preferred embodiment the chop station 190 has a pressure pad 905 which compresses the packages into a supply of adhesive paper of suitable tack as to lightly hold the packages in place while being handled and loaded into a shipping case yet permitting easy peeling from the paper for end use. The paper is drawn from a roll 925 mounted beneath the outfeed table by a suitable roll feed. The paper has a tacky surface 920 and a release surface 930, and the formed, filled, sealed and cut packages adhere to the tacky surface 920. The packages, now adhered to the adhesion paper, are lightly pressed downward by an adjustable floating pressure plate onto a high friction belt indexing conveyor which advances them to the cutoff station 200 where a flying blade 940 transversely cuts the adhesion paper on signal to supply a sheet of collated packages.

Figure 9B:
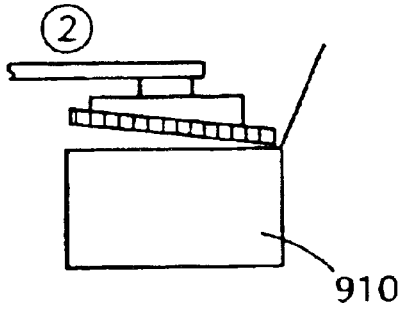
FIG. 9*b* illustrates a side view of the transport plate with a sheet of packages in position over a carton.
Figure 9C:
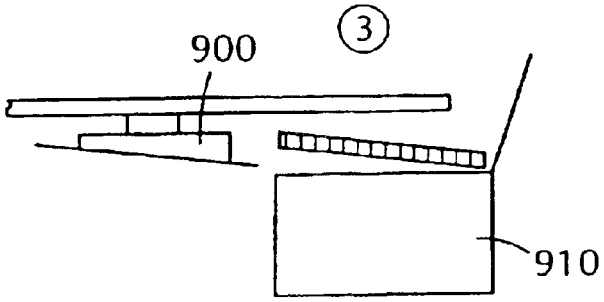
FIG. 9*c* illustrates a side view of the transport plate returning to a loading position after having been sharply accelerated and slipped out from beneath the collated sheet of packages, with the sheet of packages in a free fall into the carton.

In a further preferred embodiment the yet to be cut sheet carries forward off the outfeed table onto a "flying" carrier member 900 which, at the instant after the transverse blade cuts the sheet of collated packages, rapidly advances the sheet of collated packages to a point directly over a waiting shipping carton. At the end of the forward advance of the carrier member 900, it is sharply accelerated in the reverse direction, thereby slipping out from beneath the sheet of packages whose inertia holds it still, causing it to drop vertically downward into the carton. This operation is shown in FIGS. 9*b* and 9*c*, in which FIG. 9*b* illustrates a side view of the transport plate 900 with a sheet of packages in position over a carton 910, and FIG. 9*c* illustrates a side view of the transport plate 900 returning to a loading position after having been sharply accelerated and slipped out from beneath the collated sheet of packages, with the sheet of packages in a free fall into the carton 910.

The smooth release coated surface of the flying carrier member 900 may require vacuum means to hold the sheet in place on the carrier plate on which the collated sheet of packages rests. The carrier plate may be tilted with its trailing edge at the time of loading being higher than its leading edge when it first receives the sheet of packages just prior to its initial advance to transport the sheet of package to a point directly over the shipping carton. On the first leg of its cycle the vacuum draws and holds it on the smooth release coated surface of the carrier, and the angle aids in "pushing" the package assembly forward. On the sharp accelerated return, the vacuum is released, and the carrier plate tends to instantly draw away from the sheet of packages because of its sloped configuration.

Figure 10:
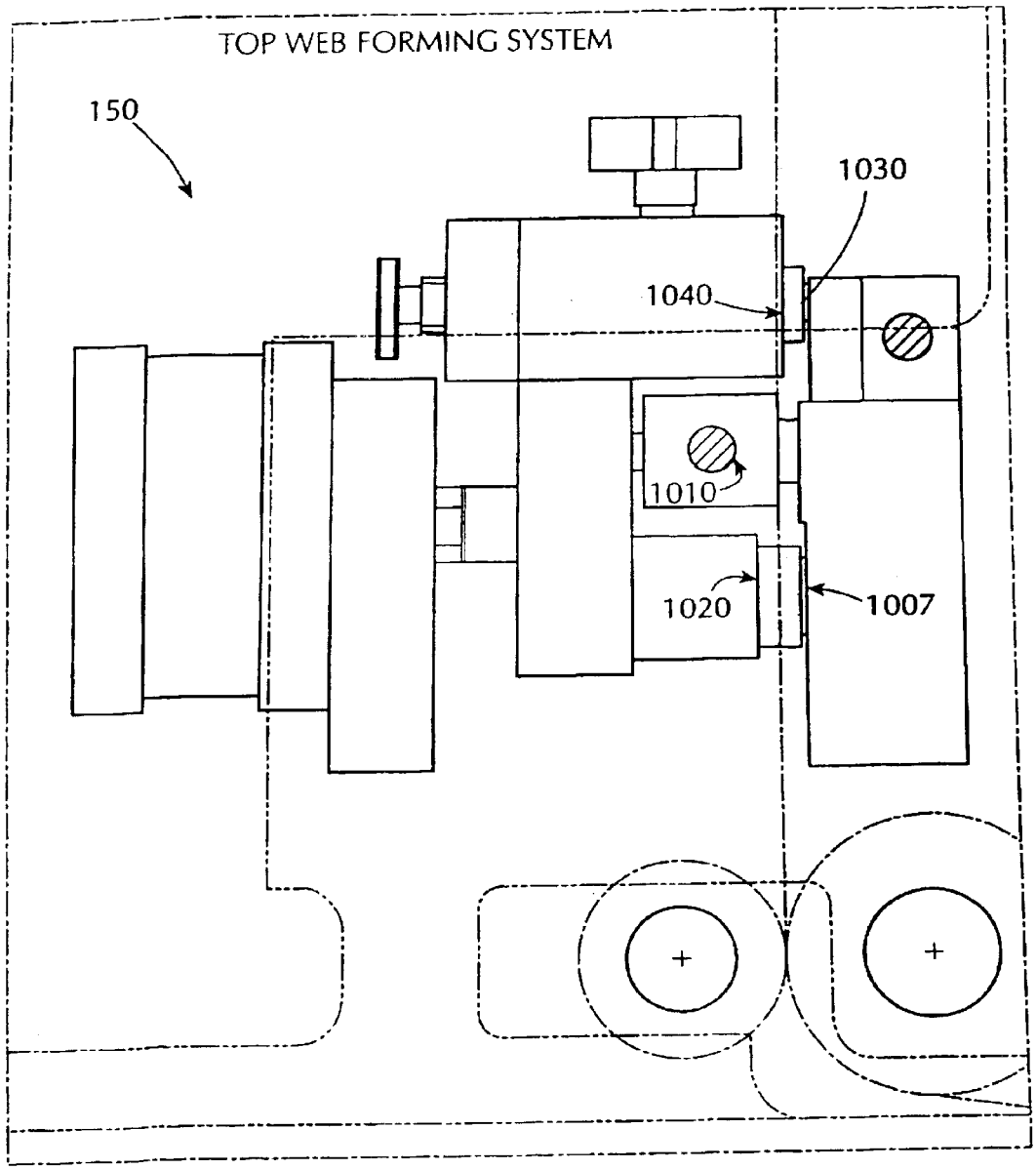
FIG. 10 illustrates a top web forming system.

It may also be seen that the top web may also be formed. An example of a top web forming station 150 is shown in FIG. 10. As shown in that Figure, top web forming station 150 may comprise forming dies 1007, 1020, a cartridge heater 1010, a heated blade 1030, and an anvil 1040.

What is claimed is:

1. A machine capable of automatic high speed thermoforming and production of formed-filled-sealed pliable packages each having a very thin membrane-like cover and a thin plastic film lower product containment pocket formation having a scored stress concentrating formation in a portion of its side wall comprising:

drive means to intermittently advance a pair of parallel transport chains having means to secure and pull bottom web material from an intermittently braked roll of web of thermoformable plastic to advance said web of thermoformable plastic, said transport chains advancing bottom web material past a series of stations, said series comprising:

a hot scoring station, comprising a vertically reciprocating device, where said web is accurately scored in a series of independent diagonal scores to depths within 0.0002 inches accuracy;

a platen heating station comprising heated upper and lower platens which reciprocate vertically together and apart adjacent to said hot scoring station where said web is controllably heated to thermoforming temperatures;

a forming station where said heated web is formed, said forming station including forming die means for forming a series of spaced product containment pocket formations each embodying a stress concentrating system with a fault line encompassed by a flat unformed rim portion;

a filler station, said filler station including means for filling each said pocket formation with an equal amount of a product supplied to said filler station; and driven roller means intermittently advancing a top web material in timed relationship with the intermittent advance of said bottom web material with each pocket formation, said driven roller means transporting said top web in substantially parallel, closely adjacent proximity to and above said bottom webs filled pocket formations to a sealing station where top web is sealed to bottom web about each filled product formation to create a series of rectangular rim seals about each pocket, said transport chains next advancing said sealed bottom web and top web to a further series of stations comprising:

a punch station, which punches shaped apertures in said rectangular rim seals which rim said pocket formations with a punched hole at each end of the rims of the pocket formations and between each pocket formation;

a vertically reciprocating longitudinal cutting station to shear the films by means of diagonal blades in a cut which travels between said punched holes to create longitudinal rims with punch formed corners along now sealed package members without distorting their shape and alignment; and a transverse cutting station which transversely slits the rims between said pocket formations to separate said sealed packages into completely individual generally rectangular finished packages with sealed rims and punched corners;

wherein said sealed packages with sealed rims are collated by collation means comprising:

a lightly adhesive collation paper intermittently advanced about an idler roller; and a pressure pad mounted on a vertically reciprocating transverse cutting means which on its downward stroke compresses a row of individual finished packages onto an adhesive side of the collation paper which row is then indexed forward for the next cycle by indexing means comprised of a high friction indexing belt conveyor under the collation paper with an adjustable floating pressure plate lightly pressing downward on said individual finished packages to aid the friction belt in drawing the collation paper forward as well as to further insure said packages adhesion to the collation paper to create a continuous sheet of collated packages, said continuous sheet of collated packages having been advanced onto a flying carrier plate member with vacuum means to maintain the sheet in place on said carrier plate member which is attached to a high speed pneumatic transport platform, a flying blade attached to another high speed transverse transport platform on signal instantly slits the collation Raper between said packages alongside the trailing edge of said flying blade into an individual sheet resting on said flying carrier plate member;

upon completion of the advance of each slit sheet onto said carrier plate member, said plate member, immediately transports said sheet of packages to a point directly over a waiting shipping carton, and said pneumatic transport platform carrying said flying plate member on reaching said point, instantly reverses with sharp acceleration and simultaneous with a vacuum release moves sharply out from under the sheet whereupon said sheet, due to its inertia, is left in mid air to drop, into the carton.

2. The machine of claim 1, where the means to secure and pull bottom web material by the pair of web transport chains comprises a series of upstanding pin members mounted on said chains and impaler means to impale said web material on said pins along each to its lateral edges.

3. The machine of claim 2, where said scoring station comprises vertically reciprocating micrometer adjustable anvils and controllably heated scoring blades where said web is scored by said anvils compressing said web against said heated scoring blades to a controllably accurate depth during the rest period of the intermittent cycling.

4. The machine of claim 3, where said heating station comprises upper and lower vertically reciprocating contact platens which compress said web between said platens to controllably heat said web to necessary temperatures for thermoforming.

5. The machine of claim 4, where said controllably heated web is formed by forming means including at least one of the following vacuum means, air pressure means, forming die means, plug assist means capable of including integral male die means to mate with female die means in the lower forming die, capable of at least one of the following, vacuum forming, air pressure forming, plug and die forming, and forming a series of pocket formations having integral stress concentrator means.

6. The machine of claim 5, where said top web can be made to register print with each pocket formation on signal picked up from said web.

7. The machine of claim 6, where said sealing station comprises vertically reciprocating upper and lower heat sealing dies controllably heated and chill dies to quickly cool and set seals.

8. The machine of claim 7, where said punch station comprises a series of male and female punch die sets that punch the sealed upper and lower web to create corners.

9. The machine of claim 8, where said longitudinal cutting station comprises a vertically reciprocating longitudinal chop member containing a series of angled blades which on traveling vertically downward enter the row of the punched holes during the rest cycle of the intermittent index of the formed, filled connected packages and to longitudinally shear the films in a cut which travels between the punched holes.

10. The machine of claim 9, where said transverse cutting means comprise a slotted transverse anvil and a transverse blade holder with angled blades mounted on it, both reciprocating vertically toward and away from each other to allow said fully made and filled packages to index between them when they are apart, said angled blades so aligned that said blades enter said slot on their downward stroke after passing through the unformed web portions between packages to be cut through, stripper means to prevent the packages from lifting up when the blades are withdrawn.

11. A machine capable of automatic high speed thermoforming and production of formed-filled-sealed pliable packages each having a cover member and a thermoformable plastic film lower product containment pocket formation having a scored stress concentrating formation in a portion of its side wall comprising:

drive means to intermittently advance a pair of parallel transport chains having means to secure and pull bottom web material from an intermittently braked roll of web of thermoformable plastic to advance said web of thermoformable plastic, said transport chains advancing bottom web material past a series of stations, said series comprising:

a hot scoring station, comprising a vertically reciprocating device, where said web is accurately scored in a series of independent diagonal scores to depths within 0.0002 inches accuracy;

a platen heating station comprising heated upper and lower platens which reciprocate vertically together and apart adjacent to said hot scoring station where said web is controllably heated to thermoforming temperatures;

a forming station where said heated web is formed, said forming station including forming die means for forming a series of spaced product containment pocket formations each embodying a stress concentrating system with a fault line encompassed by a flat unformed rim portion;

a filler station, said filler station including means for filling each said pocket formation with an equal amount of a product supplied to said filler station; and driven roller means intermittently advancing a top web material in timed relationship with the intermittent advance of said bottom web material with each pocket formation, said driven roller means transporting said top web in substantially parallel, closely adjacent proximity to and above said bottom webs filled pocket formations to a sealing station where top web is sealed to bottom web about each filled product formation to create a series of rectangular rim seals about each pocket said transport chains next advancing said bottom web and top web to a further series of stations comprising:

a punch station, which punches shaped apertures in said rectangular rim seals which rim said pocket formations with a punched hole at each end of the rims of the pocket formations and between each pocket formation;

a vertically reciprocating longitudinal cutting station to shear the films by means of diagonal blades in a cut which travels between said punched holes to create longitudinal rims with punch formed corners along now sealed package members without distorting their shape and alignment; and a transverse cutting station which transversely slits the rims between said pocket formations to separate said sealed packages into completely individual generally rectangular finished packages with sealed rims and punched corners;

wherein said sealed packages with sealed rims are collated by collation means comprising:

a lightly adhesive collation paper intermittently advanced about an idler roller; and a pressure pad mounted on a vertically reciprocating transverse cutting means which on its downward stroke compresses a row of individual finished packages onto an adhesive side of the collation paper which row is then indexed forward for the next cycle by indexing means comprised of a high function indexing belt conveyor under the collation paper with an adjustable floating pressure plate lightly pressing downward on said individual finished packages to aid the friction belt in drawing the collation paper forward as well as to further insure said packages adhesion to the collation paper to create a continuous sheet of collated packages, said continuous sheet of collated packages having been advanced onto a flying carrier plate member with vacuum means to maintain the sheet in place on said carrier plate member which is attached to a high speed pneumatic transport platform, a flying blade attached to another high speed transverse transport platform on signal instantly slits the collation paper between said packages alongside the trailing edge of said flying blade into an individual sheet resting on said flying carrier plate member;

upon completion of the advance of each slit sheet onto said carrier plate member, said plate member, immediately transports said sheet of packages to a point directly over a waiting shipping carton, and said pneumatic transport platform carrying said flying plate member on reaching said point, instantly reverses with sharp acceleration and simultaneous with a vacuum release moves sharply out from under the sheet whereupon said sheet, due to its inertia is left in mid air to drop into the carton; and wherein the machine further comprises a forming station so mounted as to heat and form the top web.

12. The machine of claim 11, where said forming stations comprises, a pair of opposing members with at least one member reciprocating;

a preheating platen system with reciprocal members of the platen system mounted on each opposing member; and forming die system with reciprocal members mounted on each opposing member.

13. The machine of claim 12, where said opposing members contain hot scoring capabilities comprising:

a series of heating scoring blades mounted in blade holders driven against micrometer adjustable anvils so as to score the web indexing between the opposing members when the web is at rest and the opposing members are reciprocating.

14. A machine capable of automatic high speed thermoforming and production of formed-filled-sealed packages comprising:

drive means to advance a pair of parallel transport chains having means to secure and pull bottom web material from a roll of web of thermoformable plastic to advance the web of thermoformable plastic, said transport chains advancing bottom web material past a series of stations, said series comprising:

a hot scoring station, comprising a vertically reciprocating device, where said bottom web material is accurately scored;

a heating station where said web is controllably heated to thermoforming temperatures;

a forming station where said heated web is formed, said forming station including forming die means which can form a series of spaced product containment pocket formations encompassed by a flat unformed rim portion;

a filler station, said filler station including means for filling each said pocket formation with an amount of a product supplied to said filler station; and driven roller means advancing a top web material in timed relationship with the advance of said bottom web material, said driven roller means transporting said top web in substantially parallel, closely adjacent proximity to and above said bottom webs filled pocket formations to a sealing station where top web is sealed to bottom web about each filled product formation to create a series of rectangular rim seals about each pocket, said transport chains next advancing said bottom web and top web to at least one station where the rectangular rim seals between said pocket formations are cut to completely separate sealed packages;

wherein said sealed packages with sealed rims are collated by collation means comprising:

a lightly adhesive collation paper intermittently advanced about an idler roller; and a pressure pad mounted on a vertically reciprocating transverse cutting means which on its downward stroke compresses a row of individual finished packages onto an adhesive side of the collation paper which row is then indexed forward for the next cycle by indexing means comprised of a high friction indexing belt conveyor under the collation paper with an adjustable floating pressure plate lightly pressing downward on said individual finished packages to aid the friction belt in drawing the collation paper forward as well as to further insure said packages adhesion to the collation paper to create a continuous sheet of collated packages, said continuous sheet of collated packages having been advanced onto a flving carrier plate member with vacuum means to maintain the sheet in place on said carrier plate member which is attached to a high speed pneumatic transport platform, a flying blade attached to another high speed transverse transport platform on signal instantly slits the collation paper between said packages alongside the trailing edge of said flying blade into an individual sheet resting on said flying carrier plate member;

upon completion of the advance of each slit sheet onto said carrier plate member, said plate member immediately transports said sheet of packages to a point directly over a waiting shipping carton, an said pneumatic transport platform carrying said flying plate member on reaching said point instantly reverses with sharp acceleration and simultaneous with a vacuum release moves sharply out from under the sheet whereupon said sheet, due to its inertia, is left in mid air to drop into the carton.

15. A machine capable of automatic high speed thermoforming and production of formed-filled-sealed packages comprising:

drive means to advance a pair of parallel transport chains having means to secure and pull bottom web material from a roll of web of thermoformable plastic to advance the web of thermoformable plastic, said transport chains advancing bottom web material past a series of stations, said series comprising:

a heating station where said web is controllably heated to thermoforming temperatures;

a forming station where said heated web is formed, said forming station including forming die means which can form a series of spaced product containment pocket formations encompassed by a flat unformed rim portion;

a filler station, said filler station including means for filling each said pocket formation with an amount of a product supplied to said filler station; and driven roller means advancing a top web material in timed relationship with the advance of said bottom web material, said driven roller means transporting said top web in substantially parallel, closely adjacent proximity to and above said bottom webs filled pocket formations to a sealing station where top web is sealed to bottom web creating sealed areas between said pocket formations, said transport chains next advancing said sealed bottom web and top web combination to at least one station where the sealed areas between said pocket formations are cut to completely separate sealed packages;

wherein said sealed packages with sealed rims are collated by collation means comprising:

a lightly adhesive collation paper advanced about a roller to which the sealed packages are adhered;

means for cutting said collation paper into discrete cut sheets;

a flying carrier plate member with vacuum means to maintain the sheet in place on said carrier plate member, wherein upon completion of the advance of each cut sheet with adhered packages onto said carrier plate member, said carrier plate member transports said sheet of packages to a location over a container, and upon said carrier plate member reaching said location, said carrier plate member instantly reverses with sharp acceleration and simultaneous with a vacuum release moves out from under the sheet of packages, whereupon said sheet of packages drops into the container.

16. A collation apparatus for use with a form-fill-seal machine comprising:

a lightly adhesive collation paper intermittently advanced about an idler roller; and a pressure pad mounted on a vertically reciprocating transverse cutting means which on its downward stroke compresses a row of individual finished packages onto an adhesive side of the collation paper which row is then indexed forward for the next cycle by indexing means comprised of a high friction indexing belt conveyor under the collation paper with an adjustable floating pressure plate with a smooth release coated surface lightly pressing downward on said individual finished packages to aid the friction belt in drawing the collation paper forward as well as to further insure said packages adhesion to the collation paper to create a continuous sheet of collated packages, said continuous sheet of collated packages having been advanced onto a flying carrier plate member with vacuum means to maintain the sheet in place on said carrier plate member which is attached to a high speed pneumatic transport platform, a flying blade attached to another high speed transverse transport platform on signal instantly slits the collation paper between said packages alongside the trailing edge of said flying blade into an individual sheet resting on said flying carrier plate member;

upon completion of the advance of each slit sheet onto said carrier plate member, said plate members, immediately transports said sheet of packages to a point directly over a waiting shipping carton, ands said pneumatic transport platform carrying said flying plate member on reaching said point instantly reverses with sharp acceleration and simultaneous with a vacuum release moves sharply out from under the sheet whereupon said sheet, due to its inertia, is left in mid air to drop into the carton.

17. The collation apparatus of claim 16, which said flying carrier plate member is tilted with its leading edge lower than its trailing edge.

* * * * *

UNITED STATES PATENT AND TRADEMARK OFFICE

CERTIFICATE OF CORRECTION

PATENT NO. : 6,845,597 B2
DATED : January 25, 2005
INVENTOR(S) : Redmond

It is certified that error appears in the above-identified patent and that said Letters Patent is hereby corrected as shown below:

Column 1,
Line 6, “now abandoned” should read -- now abandoned, --.

Column 4,
Line 6, “case” should read -- cause --;
Line 7, “are” should read -- arc --; and
Line 11, “holds” should read -- holding --.

Column 6,
Line 26, “Raper” should read -- paper --; and
Line 31, “plate member,” should read -- plate member --.

Signed and Sealed this

Thirtieth Day of August, 2005

JON W. DUDAS
*Director of the United States Patent and Trademark Office*